US006684677B1

(12) United States Patent
Bär et al.

(10) Patent No.: US 6,684,677 B1
(45) Date of Patent: Feb. 3, 2004

(54) METHOD AND DEVICE FOR REMOVING DENTS FROM SHEET METAL PARTS

(75) Inventors: Kai K. O. Bär, Bruchmühl (DE); Rainer Gaus, Bruchmühl (DE); Frank Weckenmann, Hohenwart (DE)

(73) Assignee: Advanced Photonics Technologies AG, Bruckmuhl-Heufeld (DE)

( * ) Notice: Subject to any disclaimer, the term of this patent is extended or adjusted under 35 U.S.C. 154(b) by 10 days.

(21) Appl. No.: 10/048,898

(22) PCT Filed: Aug. 2, 2000

(86) PCT No.: PCT/EP00/07493

§ 371 (c)(1),
(2), (4) Date: Jul. 15, 2002

(87) PCT Pub. No.: WO01/10579

PCT Pub. Date: Feb. 15, 2001

(30) Foreign Application Priority Data

Aug. 6, 1999 (DE) ..... 199 37 277

(51) Int. Cl.[7] ..... B21D 1/12
(52) U.S. Cl. ..... 72/342.1; 72/705
(58) Field of Search ..... 72/342.1, 342.5, 72/342.6, 364, 705

(56) References Cited

U.S. PATENT DOCUMENTS

| | | | | |
|---|---|---|---|---|
| 3,852,990 A | * | 12/1974 | Sparling | 72/364 |
| 3,854,029 A | * | 12/1974 | Fenollar | 72/364 |
| 3,959,619 A | | 5/1976 | Schill | 219/50 |
| 4,044,590 A | | 8/1977 | Strahm | 72/342 |
| 5,479,804 A | | 1/1996 | Cook | 72/35 |
| 6,079,245 A | * | 6/2000 | Sarrion | 72/705 |

FOREIGN PATENT DOCUMENTS

| | | |
|---|---|---|
| DE | 43 16 829 A1 | 11/1994 |
| DE | 195 14 285 C1 | 6/1996 |
| DE | 196 03 974 A1 | 8/1997 |
| DE | 198 04 577 A1 | 8/1999 |
| DE | 299 22 180 U1 | 4/2000 |
| FR | 1 419 497 A | 2/1966 |
| NL | 7 401 688 A | 8/1975 |

OTHER PUBLICATIONS

Patent Abstracts of Japan, vol. 008, No. 177 (M–317), Aug. 15, 1984 and JP 59 070426 A (Nihon Shiyariyo Seizou KK) Apr. 20, 1984.

Patent Abstracts of Japan, vol. 008, No. 170 (M–315) Aug. 7, 1984 and JP 59 064119 A ( Hitachi Seisakusho KK), Apr. 12, 1984.

Patent Abstracts of Japan, vol. 008, No. 028 (M–274), Feb. 7, 1984 and JP 58 187213 A (Hitachi Seisakusho KK), Nov. 1, 1983.

* cited by examiner

*Primary Examiner*—Lowell A. Larson
(74) *Attorney, Agent, or Firm*—Marshall, Gerstein & Borun LLP

(57) ABSTRACT

Method of removing dents from sheet-metal parts, in particular from lacquered parts of an automobile body, wherein the metal part (3) in the region of a dent (B) is warmed locally in a substantially non-contact manner, in such a way that a mechanical tension gradient produced by the local warming causes the dent to spring back so as to restore the original shape of the metal part.

15 Claims, 1 Drawing Sheet

METHOD AND DEVICE FOR REMOVING DENTS FROM SHEET METAL PARTS

Figure 1:
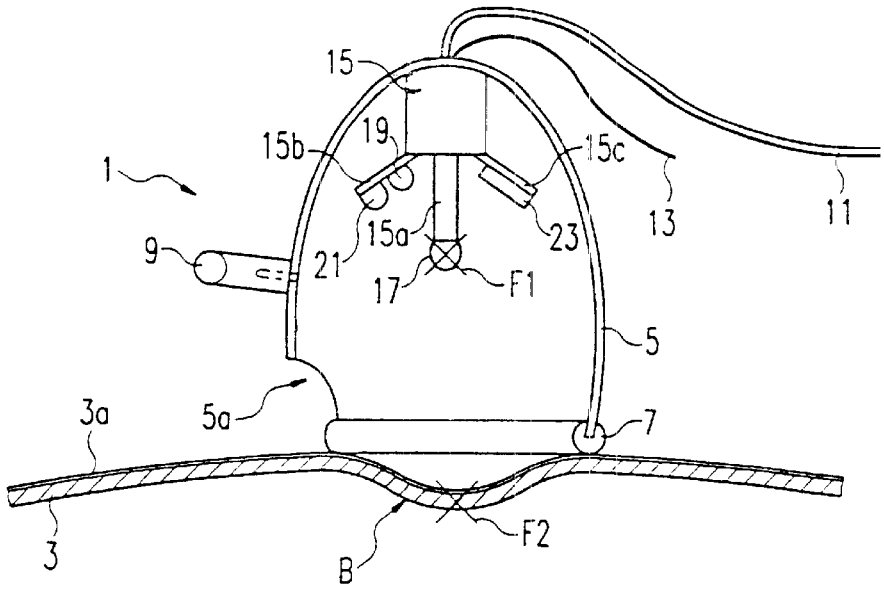

The invention relates to a method of removing dents from parts made of sheet metal, in particular lacquered parts of an automobile body, as well as an apparatus for implementing this method.

The removal of dents from pieces of sheet metal with the aim of restoring, as far as possible, an original (flat or curved) shape is a task that occurs in many branches of industry and the trades. Although a large number of technical procedures and devices have been developed to accomplish this task, some of which are commercially available, the problem is still often solved by the manual efforts of trained personnel. This entails considerable expense.

Probably the most economically important application of dent-removing methods and apparatus is the repair of motor vehicles.

Hail damage to cars, in particular to new cars parked in the storage yards of automobile manufacturers, alone accounts for an annual average of several hundred million DM in Germany. The dents caused by hailstones are usually small and rounded, so that their shape and dimensions often allow them to be pressed out manually. However, somewhat larger indentations that cause a plastic deformation of the metal cannot be removed in this way. To eliminate such relatively large dents various kinds of apparatus have been proposed. These operate, for example, on the basis of locally reduced pressure or on a magnetic principle, and are intended to restore the original shape of the affected piece of metal without elaborate dismantling procedures. Application of such apparatus in some cases demands great experience and hence must be carried out by correspondingly highly paid workers, and nevertheless often is not as successful as would be wished. In many cases, therefore, additional laborious lacquering work is inevitable.

The objective of the invention is thus to disclose a method and an apparatus for the removal of dents from pieces of sheet metal that are distinguished in particular by low production and operating costs and high service value.

This objective is achieved with respect to its methodological aspect by a method with the characteristics given in claim 1 and with respect to the apparatus by an arrangement with the characteristics given in claim 11.

The invention includes the essential idea that to remove relatively small dents thermal energy is introduced into a piece of sheet metal in a narrowly circumscribed region thereof—specifically, the region of the dent—and the metal is caused to spring back into the original state by the resulting mechanical tension gradient. Surprisingly, the inventors discovered that this action can be achieved even with warming to comparatively low temperatures, well below critical temperatures at which the customary surface coatings of sheet-metal parts (in particular, the lacquer coating of an automobile body) undergo thermal damage. This enables a very broad application of the proposed method, especially for eliminating small sites of damage to automobiles such as the hailstone damage described above.

In a preferred embodiment of the method, the local warming is produced by targeted application of radiation, a substantial proportion of which is in the near-infrared region, in particular, in the wavelength region between 800 nm and 2 $\mu$m. In this embodiment the method can be implemented with an apparatus that is particularly simple and economical to manufacture and can be operated by workers with no special experience. By suitably adjusting the irradiation wavelength to the characteristics of the materials involved (the metal and whatever coating is present), it becomes possible in particular to introduce the energy substantially directly into the metal, while largely avoiding the coating.

Alternatively, the dented metal part can be locally warmed by an inductive means or by a directed stream of hot air.

A crucial consideration is that the warming is done in a targeted and limited manner, and in particular is substantially punctate in the central region and/or annular in the peripheral region of the dent that is to be removed. As a result, the tension gradient that causes the metal to spring back into the original shape is built up in a controlled manner. In the case of coated metal parts, the local warming is in particular limited to a final temperature, which is low enough that irreversible changes in the coating (e.g., a layer of lacquer) cannot yet occur. Even under this limiting condition, suitable preliminary setting of the size and shape of the warming zone and, where appropriate, of the rate of heating preserve sufficient degrees of freedom to enable indentations of various sizes and shapes to be eliminated from metal pieces made of various materials, in particular lacquered sheet steel.

Especially for repairing the latter, according to tests carried out by the inventors it has proved sufficient to warm the region of the dent in a lacquered automobile body locally to a temperature in the range between 100° C. and 200° C.

In an advantageous further development of the idea underlying the invention, during the local warming the momentary shape of the metal part is monitored, and when springing back into the original shape is detected, the response is to terminate the warming process. This further development makes it possible partially to automate the method. In combination with the above-mentioned temperature limitation, this embodiment in particular enables the method to be carried out even by personnel with no special training and experience.

When the metal parts to be processed are of exactly the same kind and have similar coatings—as is the case, for instance, when hail damage to motor vehicles is being repaired—the above-mentioned temperature limitation can be achieved by a suitable design of the heating device, so that where appropriate it is possible to eliminate the need for temperature measurement. It is somewhat more complicated for the method to include the measurement and regulation of momentary temperature, but an apparatus capable of these functions can also be used for a wide variety of sheet metals and coatings.

Implementation of the method can be additionally facilitated with a design in which the site of the local warming is marked by a visible light beam, and the heating device is directed towards the spot of light thus produced on the metal part.

An apparatus for carrying out the method described above comprises in particular a heating device that functions in a substantially non-contact manner, which advantageously comprises an adjustable heat-introduction region. Such a device can be optimally adapted to indentations of various sizes and to metal sheets that differ in thickness.

In an especially simple and economical embodiment the heating device operates in the near-infrared region (NIR) and exhibits a predetermined directional characteristic for the emitted radiation. Such a heating device preferably comprises an approximately punctate halogen light source, which is operated at a surface temperature of 2500 K or more, in particular 2900 K or more.

In an embodiment that is preferred because of its versatility regarding possible applications, the heating by NIR radiation has a variable directional characteristic, achieved in particular by an adjustable aperture or apertures and/or mechanical adjustment means—in particular to modify the position or shape of a reflector.

In accordance with the preferred further developments of the basic idea of the method, as described above, the apparatus in particular comprises a temperature-measurement device to monitor the surface temperature of the metal part in the warming region, which is advantageously connected to a control input of the heating device so that a temperature regulation (at least a temperature limitation) is produced in dependence on the result of the temperature measurement. In an advantageous embodiment the temperature-measurement device incorporates a non-contact sensor, specifically a radiation pyrometer.

In another preferred embodiment of the proposed apparatus an aiming means is provided with which to direct the heating device towards the region of a dent. This aiming means specifically comprises a radiator for visible light that is fixedly attached to the heating device and is either self-focussing or provided with associated focussing means, so as to produce a narrowly circumscribed spot of marking light on the metal part.

This marker enables the operator to position the heating device precisely with respect to the dent.

An additional preferable feature is the provision of an optical measuring device to monitor the momentary shape of the metal part, which can be constructed for instance as a laser-triangulation device. As a result of the measurement of the surface shape of the sheet metal, in particular this device sends out a "finished" signal as soon as it detects that the indented area has sprung back so as to restore the original state of the metal part. This signal can be used to turn off the heating device directly and/or can be displayed visually to the operator.

It is especially advantageous to use a single light source for both the aiming and the measuring device in combination, and in this regard it is particularly advantageous to employ a laser radiation source, for example an economical laser-diode device.

Figure 2:
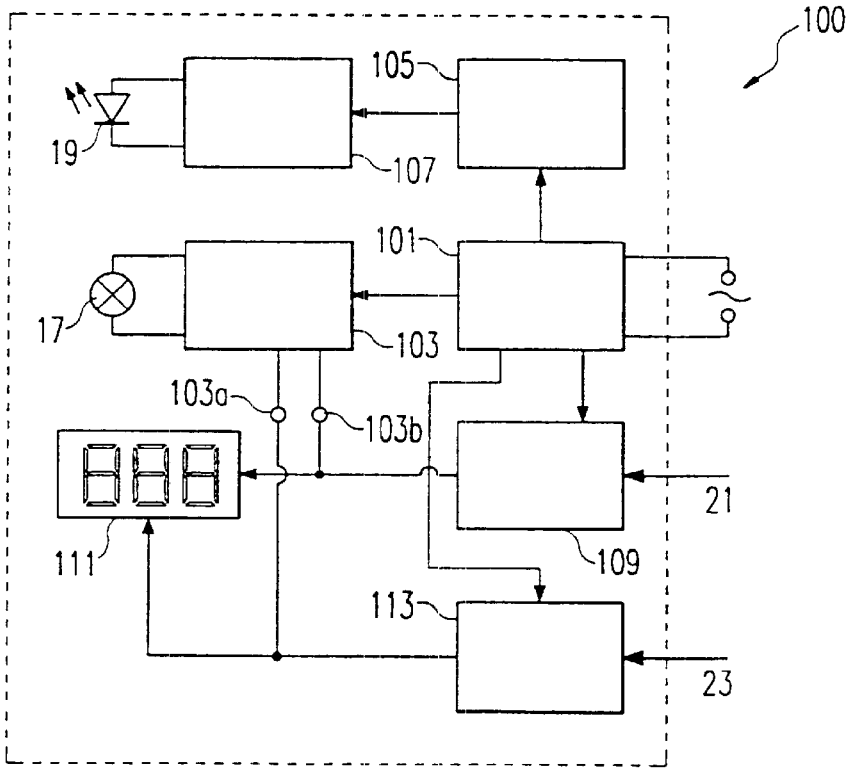

Advantages and useful features of the invention will additionally be apparent from the subordinate claims and from the following description of exemplary embodiments with reference to the figures, wherein FIG. 1 is a cross-sectional drawing of a dent-removal hood as the main component of an apparatus to remove dents from sheet-metal parts according to one embodiment of the invention, and FIG. 2 is a schematic representation of the essential components of an apparatus for dent removal according to one embodiment of the invention, in the form of a block diagram.

FIG. 1 shows a sketch of a hood 1 that is used to remove a small dent B in a piece of sheet metal 3 that forms part of an automobile body and is provided with surface coating of lacquer 3*a*. The external shape of the hood 1 is determined bag a reflector 5 that is made of metal or at least metallized on its inner surface and has the shape of an ellipsoid of revolution, the end of which has been cut off and which has the two focal points F1 and F2. Disposed circumferentially at the edge of the reflector 5 is a rubber ring 7, by way of which the reflector can be harmlessly set onto the body metal 3. The reflector 5 also comprises an opening 5*a* through which the region of the dent B in the body metal 3 can be observed when the hood 1 has been put into place. Finally, a plastic handle 9 is attached to the reflector so that the hood 1 can be manipulated easily and with no danger even during operation.

The dent-removal hood is connected to the alternating-current mains supply by way of a current cable 11, and to a measurement and control system (not shown here) by way of a data line 13. In the interior of the hood, screwed to the reflector 5, is a plastic carrier 15 that houses a transformer (not shown) and from which a lamp socket extends towards the focal point F1; two extension arms 15*b*, 15*c* are also disposed on the carrier 15, to hold additional components described below. In the lamp socket 15*a* is seated a halogen lamp 17, for example a Xe or Kr lamp, which is operated in such a way that it has a surface temperature of ca. 2900 K and thus emits radiation, a substantial proportion of which is in the near-infrared (NIR) region between 800 nm and 2 $\mu$m. The halogen lamp 17 is positioned at the focal point F1, so that the NIR radiation it emits is largely reflected by the reflector 5, which is shaped like an ellipsoid of revolution, in such a way that the radiation converges at the focal point F2 and hence is reflected into the center of the dent B in the body metal 3.

The extension arm 15*b* of the plastic carrier 15 supports, first, a laser diode provided with a simple projection lens, which is so positioned that the radiation it emits is directed towards the focal point F2. Also mounted on the extension arm 15*b* is a radiation pyrometer element 21, which is likewise directed towards the focal point F2 and serves to detect the surface temperature of the car-body metal 3 in the region of the dent B. The extension arm 15*c* bears a photodetector arrangement 23, which is so constructed (e.g., as a simple CCD array) and positioned that it detects the radiation from the laser diode 19 that is reflected from the metal sheet 3 in different ways, depending on the state of the metal in the region of the dent B. The photodetector arrangement 23 can, in particular, be constructed so that the reflected radiation originating in the laser diode 19 reaches it only when the configuration of the body metal is undisturbed (dashed line in drawing), or so that the radiation reflected from the region of the dent B reaches it at a different position than the radiation reflected from the undisturbed metal surface (with dent removed). Thus the photodetector arrangement 23, in cooperation with the laser diode 19, serves as a simple laser-triangulation device for measuring the surface configuration of the body metal 3 in the region of the dent B; this is discussed further below. The laser diode 19 additionally serves to mark the focal point F2 and hence the site of maximal energy input of the NIR radiation from the halogen lamp 17, and enables an operator to position the hood 1 accordingly by observing, through the opening 5*a* in the reflector 5, the spot of light produced on the body metal 3 by the laser diode 19.

The hood 1 is operated as follows: first it is set onto the body metal 3 so as to cover the dent B, then the laser diode 19 is turned on and the hood is shifted on the car body so that the light from the diode forms a spot centered in the dent B, and finally the region of the dent B is warmed by actuating a mains switch (not shown) so that the halogen lamp 17 is turned on. During the irradiation, the radiation-pyrometer element is used to detect the temperature of the body metal 3 in the region of the dent B, and the photodetector arrangement 23 is used to detect its shape; the halogen lamp 17 is turned off when the dent is found to have sprung back, restoring the original shape of the body metal, or when a prespecified permissible limiting temperature has been reached.

In the embodiment of the apparatus for implementing this method in accordance with the invention as shown in FIG. 1, which is mechanically very simple and inexpensive, the size and shape of the zone of body metal that is warmed can be modified by tilting the hood or raising it slightly; for this purpose more refined (and correspondingly more elaborate and costly) embodiments include, for example, height-adjustment means and/or an adjustable aperture to block out part of the light beam from the halogen lamp at the irradiated site. Such embodiments are within the scope of those skilled in the art and hence are not described in greater detail here.

In FIG. 2 the functional arrangement of the measurement and control elements of a dent-removing apparatus 100 is shown schematically as a block diagram. The dent-removing apparatus 100 is connected to the alternating-current mains, and from the mains voltage a power-supply unit 101 draws and stabilizes the voltage needed to operate the halogen lamp 17. This operating voltage is sent from the power-supply unit 101 to the lamp 17 by way of a power-control stage 103, which comprises two control inputs 103*a*, 103*b*. The power-supply unit 101 likewise supplies the laser diode 19, in this case by way of a rectifier stage 105 and a separate switch 107.

Two other components are also supplied by the power-supply unit 101: a temperature-measurement stage 109 connected on its input side to the radiation-pyrometer element 21 and at its output both to the control input 103*b* of the switching and power-control stage 103 and to a display unit 111; and also a surface-geometry evaluation unit 113, which at its input side is connected to the photodetector arrangement 23. At its output side, the surface-geometry evaluation unit is connected to the control input 103*a* of the switching and power-control stage 103 as well as to the display unit 111.

The function or the dent-removing apparatus 100 will already be to a great extent apparent from the above explanation of the invention. At this juncture, therefore, it will merely be pointed out in summary that by way of the radiation-pyrometer element 21, which detects the surface temperature of the car-body metal 3 (FIG. 1), the temperate-measurement, 109 and the switching and power-control stage 103, to which the halogen lamp 17 is connected, a temperature regulation is achieved, at least in the sense of a limitation of the surface temperature to a permissible maximal value at which the lacquered surface 3 is certain not to be damaged. This is accomplished by reducing the radiation output when said maximal temperature is approached, or by transiently turning off the halogen lamp 17. Complete switching off of the halogen lamp 17 is brought about by the photodetector arrangement 23 and the surface-geometry evaluation unit 113 as well as by the control inputs 103*a* of the switching and power-control stage 103, as soon as a prespecified signal processing in the surface-geometry evaluation unit signals the result that a significant change in the geometry of the sheet metal has occurred in the region of the dent, in the sense that the metal has sprung back into the original, undistorted shape. In parallel to these control or regulation processes, the operator is informed about the actual surface temperature, by way of the display unit 111, and also, for example by a signal lamp, about the fact that the original shape of the metal has been restored, i.e. that the dent-removing process has been successful.

The invention can be put into practice not only by the embodiment described above, but also by a large number of modifications thereof.

For example, the reflector geometry of the mechanical-optical part of the dent-removing apparatus, termed "dent-removal hood" above, is variable just as is the internal construction. In particular, of the functional components mentioned above, individual ones can be omitted in the interest of further simplification (and hence reduced cost) of the apparatus: for instance (given that the radiation source is appropriately dimensioned) the means for temperature measurement or the means for detecting the surface geometry of the body metal. Instead of using a laser diode to mark the region from which the dent is to be removed, another light source can be provided, as long as it has focussing means suitable for producing a clearly delimited light spot on the surface of the metal.

LIST OF REFERENCE NUMERALS

1 Dent-removal hood
3 Metal of motor-vehicle body
3*a* Surface layer of lacquer
5 Reflector
5*a* Opening
7 Rubber ring
9 Plastic handle
11 Current cable
13 Data line
15 Plastic carrier
15*a* Lamp socket
15*b*, 15*c* Extension arm
17 Halogen lamp
19 Laser diode
21 Radiation-pyrometer element
23 Photodetector arrangement
100 Dent-removing apparatus
101 Power-supply unit
103 Switching and power-control stage
103*a*, 103*b* Control input
105 Rectifier stage
107 Switch
109 Temperature-measurement stage
11 Display unit
113 Surface-geometry evaluation unit
F1, F2 Focal point
B Dent

What is claimed is:

1. Method of removing dents from sheet-metal parts, in particular from lacquered parts of an automobile body, wherein the metal part (3) is locally warmed in the region of a dent (B) in a substantially non-contact manner, such that a mechanical tension gradient induced by the local warming causes the dent to spring back so as to restore the original shape of the metal part, characterized in that the local warming is carried out by the directed application of radiation, a substantial proportion of which is in the near-infrared region, in particular in the wavelength region between 800 nm and 2 $\mu$m.

2. Method according to claim 1, characterized in that the local warming is substantially punctate in the central region and/or annular in the peripheral region of the dent.

3. Method according to claim 1, characterized in that the local warming is limited to a final temperature below a critical temperature at which irreversible alterations would be produced in a coating (3*a*) of the metal part (3), in particular a layer of lacquer.

4. Method according to claim 1, characterized in that the local warming, in particular in the case of a lacquered metal part of a car body, is carried out up to a final temperature in the region between 100° Celsius and 200° Celsius.

5. Method according to claim 1, characterized in that during the local warming the momentary shape of the metal part (3) in the region of the dent (B) is monitored and when it is detected that the metal has spring back into its original shape, the response is to terminate the warming.

6. Method according to claim 1, characterized in that the during the local warming the temperature at the site of warming is measured.

7. Method according to claim 1, characterized in that the region of a dent (B) is marked as the site for local warming by means of a visible light beam.

8. Apparatus for implementing the method according to claim 1, characterized by a heating device (5, 17, 101, 103) that operates in the near-infrared region, in particular in the wavelength range between 800 nm and 2 $\mu$m, and in particular has an adjustable heat-introduction region and/or adjustable heat output, for the substantially non-contact local warming of the metal part (3).

9. Apparatus according to claim 8, characterized in that the heating device (5, 17, 101, 103) is constructed as an NIR-radiation heater with predetermined directional characteristic, comprising in particular an approximately punctate halogen lamp (17) that is operated at a surface temperature of 2500 K or higher.

10. Apparatus according to claim 9, characterized in that the NIR-radiation heater has a directional characteristic that can be altered, in particular by at least one aperture and/or mechanical displacement means.

11. Apparatus according to claim 8, characterized by a temperature-measurement device (21, 109) to detect the temperature of the metal part (3) in the warming region (B), which in particular is connected to a control input (103*b*) of the heating device (103) in such a way that by controlling the heating device in response to the output signal from the temperature-measurement device, the temperature in the warming region is at least limited.

12. Apparatus according to claim 11, characterized in that the temperature-measurement device operates in a non-contact manner and in particular comprises a radiation pyrometer (21).

13. Apparatus according to claim 8, characterized by an aiming device (19) to direct the heating device (5, 17) towards the region of the dent (B), such that the aiming device in particular comprises a radiator for focused visible light that is fixedly attached to the heating device.

14. Apparatus according to claim 8, characterized by an optical measurement device (19, 23, 113) to detect the momentary shape of the metal part (3) in the region of the dent (B).

15. Apparatus according to claim 13, characterized in that the aiming and/or the measurement device comprises a laser-radiation source (19) that in particular serves as a common source of radiation for the aiming and the measurement device.

* * * * *